US008474934B1

(12) United States Patent
Curcio et al.

(10) Patent No.: US 8,474,934 B1
(45) Date of Patent: Jul. 2, 2013

(54) METHOD FOR IMPROVING GLOSS OF A PRINT

(75) Inventors: Brian E. Curcio, San Diego, CA (US); Joshua A. Mann, Ramona, CA (US); Dustin W. Blair, San Diego, CA (US); Glenn Thomas Haddick, San Diego, CA (US); Thomas Jeffrey Winter, Washington, DC (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 270 days.

(21) Appl. No.: 12/772,152

(22) Filed: Apr. 30, 2010

(51) Int. Cl.
*B41J 29/38* (2006.01)
*B41J 2/21* (2006.01)

(52) U.S. Cl.
USPC ..... 347/9; 347/43

(58) Field of Classification Search
None
See application file for complete search history.

(56) References Cited

U.S. PATENT DOCUMENTS

| | | | | |
|---|---|---|---|---|
| 6,866,365 | B1 * | 3/2005 | Neese et al. | 347/43 |
| 6,877,850 | B2 * | 4/2005 | Ishimoto et al. | 347/100 |
| 7,234,793 | B2 | 6/2007 | Yamazaki et al. | |
| 7,237,866 | B2 | 7/2007 | Yamazaki et al. | |
| 7,562,956 | B2 | 7/2009 | Yamazaki et al. | |
| 2006/0033767 | A1 | 2/2006 | Weast | |
| 2006/0066647 | A1 * | 3/2006 | Koga et al. | 347/5 |
| 2007/0211097 | A1 | 9/2007 | Yamazaki et al. | |

* cited by examiner

*Primary Examiner* — Geoffrey Mruk

(57) ABSTRACT

A method for improving gloss of a print includes configuring a printing system to deposit ink drops from a plurality of inks in an ink set onto a print surface. During the depositing, the printing system is further configured to control micro-coalescence of the ink drops. The micro-coalescence is controlled by i) depositing the ink drops onto the print surface according to a predefined order of color based upon solids content, ii) adjusting a number of printing passes, iii) adjusting a delay time between the printing passes, and/or iv) depositing different amounts of the ink drops onto the print surface during different printing passes.

14 Claims, 9 Drawing Sheets

100% light cyan

Yellow onto light cyan

100% yellow

Light cyan onto yellow

| | A | B |
|---|---|---|
| Median | 69.04 | 69.64 |
| Std. Dev. | 18.50 | 15.65 |

| | A | B |
|---|---|---|
| Pass 1 | Im - lc | M - Y |
| Pass 2 | pK - mg | pK - mg |
| Pass 3 | M - Y | Im - lc |
| Pass 4 | pK - mg | pK - mg |
| Pass 5 | M - Y | Im - lc |
| Pass 6 | pK - mg | pK - mg |

| | C | D |
|---|---|---|
| Pass 1 | pK | pK |
| Pass 2 | M - pK | lm - pK |
| Pass 3 | Y -pK | lc - pK |
| Pass 4 | lm - mg | M - mg |
| Pass 5 | lc - mg | Y - mg |
| Pass 6 | mg | lg |

| | C | D |
|---|---|---|
| Median | 66.01 | 73.76 |
| Std. Dev. | 15.07 | 18.05 |

METHOD FOR IMPROVING GLOSS OF A PRINT

BACKGROUND

The present disclosure relates generally to methods of improving gloss of a print.

Inkjet printing processes are often used to effectively produce a print (i.e., a print surface having an image formed thereon). Some prints may, in some cases, exhibit a gloss that qualifies the print as being of photo quality, and such print may be referred to as a photoprint.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

The surface appearance of a print is often considered to be a significant factor in determining its quality. In many cases, the surface appearance is determined, at least in part, from its gloss. The gloss of a print often reflects the shininess of a print when ink is established on a print surface. Typically, the gloss is measured using a gloss meter (such as, for example, those manufactured by BYK-Gardner).

Figure 3:
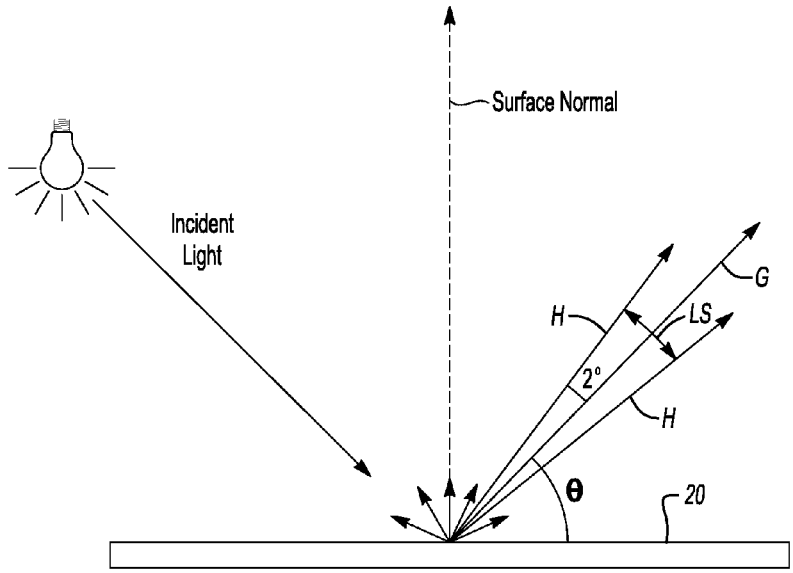
FIG. 3 is a diagram illustrating reflection of incident light against a print surface.

It has been found that gloss may be affected by changes in the physical and/or chemical properties of the ink, the print surface, or both. However, the gloss is not always effectively improved by these changes alone. For instance, pigment-based inks typically include an ink vehicle that tends to absorb into the print surface when printed thereon, while the colorant particles that were dispersed in the vehicle remain on the surface. In these instances, the final print often has a relatively rough surface that affects the gloss of the print due, at least in part, to the uneven topography of the print surface resulting from the pigment particles laying thereon. More specifically, the pigment particles that are sitting on the surface may create edges (i.e., a step function change in height from one ink drop to an adjacent ink drop) on the surface that cause incident light to scatter. For example, FIG. 3 illustrates the reflection of incident light by a print surface 20 having ink drops (not shown) deposited thereon. In instances where the topography of the print surface 20 having the ink drops deposited thereon is relatively flat, the incident light reflects off of any point on such surface 20, and the angle of the reflected light falls within a range indicative of specular reflection (as shown by arrow G in FIG. 3). The arrow G generally represents the intensity of reflected specular light, and is also representative of glossiness/shininess of the print. In instances where the topography of the print surface 20 is uneven (e.g., edges are formed between adjacent ink drops), specular reflection of the print is reduced because some of the incident light scatters off of the print surface 20 (as shown by arrows H in FIG. 3). The scattering of the light often results in haziness of the print. As used herein, haze (identified by the arrows H in FIG. 3) is the intensity of the reflected light at +/−2° of the angle of specular reflection θ. In other words, the extent that a print appears to be hazy may be determined by observing the intensity of the light at +/−2° of the specular reflection angle θ. It is to be understood, however, that haze may also be determined by observing the intensity of light at more than +/−2° of the specular reflection angle θ. In some cases, for example, haze may be determined by observing the intensity of light at any angle that is more than +/−2° and up to about +/−15° of the specular reflection angle θ.

Further, the distinctness of a print is generally based on the ratio of gloss to haze. In an example, when a print exhibits about the same haze as gloss, the print may be classified as being hazy. In some cases, the angular range of light scattering (represented by arrow LS in FIGS. 3 and 4) may also be indicative of the distinctness of the final print. In the example shown in FIG. 3, a hazy print may include one that has an angular range of light scattering that is about 4° or more.

Figure 4:
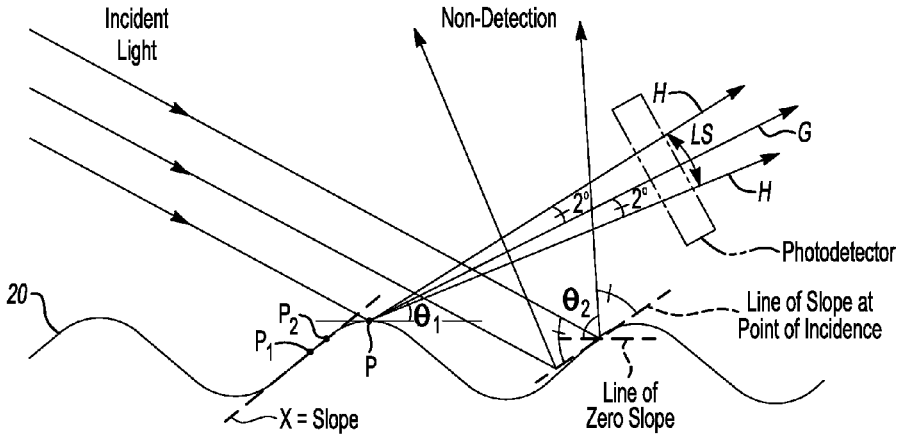
FIG. 4 is an enlarged view of a print surface illustrating the reflection of incident light against such surface.

In contrast, when a dye-based ink, for example, is deposited onto a porous print surface, the dye colorant tends to absorb into the print surface rather than lay on top. In this case, the optical characteristics (e.g., gloss, haze, and/or distinctness) of the final print remains unaffected by the colorant (i.e., the dye), and the appearance of the print is otherwise dictated by the optical characteristics of the print surface rather than by the colorant itself. As shown in FIG. 4, the porous print surface 20 may, in one example, have a topography similar to a sine wave, where each pair of adjacent points (such as, e.g., $P_1$ and $P_2$) along the surface has its own slope x. In other instances, the surface roughness may be more random than the example depicted in FIG. 4. In FIG. 4, the angle of incidence is the angle between the direction of incident light and a line normal to the surface. The angle of reflection is the angle between the direction of reflected light and a line normal to the surface. It is to be understood that the angles of incidence and reflection may also be expressed with respect to the surface, that is, as the complement of the angles of incidence and reflection previously defined. The law of reflection states that the angle of incidence is equal to the angle of reflection. A surface that reflects light more intensely in the same direction will have relatively high gloss. As shown in FIG. 4, when incident light reflects off a maximum point $P_{max}$, which has a slope x of 0, the light is reflected at an angle $\theta_1$. If reflected light is directed at an angle within the range for specular reflection, it results in gloss. In an example, light reflected within a range of 0° to 2° of angle $\theta_1$ contributes to gloss. Such maximum point $P_{max}$ may be found at the apex of each individual wave of the surface 20. However, when incident light reflects off other points along the surface 20 (e.g., points where the slope is +/−some number, and the angle (e.g., $\theta_2$) is at least 2° higher than $\theta_1$), the reflected light falls outside of the specular reflection range.

It is noted that the angle θ is measured with respect to a zero slope line, which is parallel to an average surface angle for an area on the print where gloss is to be measured. Thus, a gloss measuring device measures with respect to a macroscopic surface of the print.

Typically, a wider range of $\theta_{1,2}$ results in a decrease in gloss and an increase in haze across the surface of the print. Since there is a significantly higher number of points on the surface 20 that reflect light outside of the specular reflection range (i.e., greater than 2°) than those points that do (i.e., such as points $P_{max}$ that have the angle $\theta_1$), the final print may appear hazy.

It is to be understood that the descriptions herein of incidence and reflection in any two dimensional (2-D) plane (as shown in FIGS. 3 and 4) also applies in all other 2-D planes taken about the surface normal vector.

Furthermore, if multiple layers of ink are deposited onto the print surface 20 during printing (e.g., via multiple printing passes), such multiple layers may create interfaces that can also lead to scattering of incident light. Such interfaces may be created even when the upper-most ink layer is substantially flat, while the underlying layers are rough. For instance, the incident light reflects off the print surface 20 and refracts inwardly. When this occurs, the light reflects off of the multiple layers of the ink deposited onto the surface 20. The refraction of the light back to the surface 20 then combines with the incident light beams, and either positively or negatively reinforces the incident light producing further scattering of the light. This scattering of light affects the gloss and haze of the final print.

The quality of a print may also be determined by the uniformity of gloss of the entire print. As used herein, the term "gloss uniformity" or some variation thereof refers to a substantially uniform distribution of gloss across the surface of the print. Gloss uniformity may be a factor, for example, when multiple colors are used during printing, where such colors are obtained, for example, from an ink set. For instance, each of the colored pigments may reflect light differently (due, at least in part, to the different crystal structure of the pigments), which may lead to higher or lower gloss depending, at least in part, on the image produced. Further, the gloss of white portions of the print (i.e., the portions of the print surface where ink was not applied) is often determined from the print surface itself rather than from the optical properties of the pigment(s) in the ink. When viewed as a whole (i.e., the white portions (as shown in FIG. 4) as well as the portions having ink thereon (as shown in FIG. 3)), the print may appear to be uneven with respect to gloss.

Even further, a low density of ink drops applied to certain portions of the print surface may, in some instances, fail to form a continuous/substantially continuous ink film across the entire surface. In such instances, the ink may be viewed as small islands of ink drops on the print surface that often exhibit another surface appearance (in terms of gloss) from i) other portions having ink thereon, and/or ii) white portions of the final print.

While changes in the physical and/or chemical properties of the ink and/or of the print surface may affect gloss (as shown above), further improvement in gloss of the final print may be achieved by instituting changes to the printing system used for producing the print to achieve an optimal ink flux. Such ink flux enables adjacent ink drops to flow together such that micro-coalescence may be achieved. As such, certain changes in the printing system may be used to control the micro-coalescence of the ink drops deposited onto the print surface during inkjet printing so that an optimal ink flux may be obtained.

As used herein, the term "micro-coalescence" refers to the union of adjacent ink drops deposited onto a print surface, where such union forms a single, unitary ink drop. When micro-coalescence occurs, the ink drops flow together in a manner sufficient to form a continuous/substantially continuous ink film on the print surface. As used herein, a continuous/substantially continuous ink film refers to one that appears continuous to the naked eye. Typically, a print surface having micro-coalesced ink drops often does not exhibit surface blemishes that are noticeable by the naked eye.

Without being bound to any theory, it is believed that at least some micro-coalescence of adjacent ink drops deposited onto the print surface is desirable to improve gloss and uniformity of the final print. It is to be understood, however, that too much coalescence between the adjacent ink drops may result in flooding of such ink drops, which is often referred to as macro-coalescence. Macro-coalescence may, in some instances, create surface blemishes that are visible to the naked eye. In some cases, such a print may have a granular appearance. As such, images suffering from macro-coalescence may have undesirable aesthetics.

The present inventors have found that micro-coalescence occurs when the effective size of the coalesced ink drops is about two to three times larger than an individual, non-coalesced ink drop, and the micro-coalescence tended to improve gloss. When a portion of the final print including the micro-coalesced ink drops is similar in size to a portion of the final print including individual ink drops, the print may exhibit lower gloss. It is believed that this potential decrease in gloss may be due, at least in part, to a step function change in height of the individual ink drops that leads to a higher average slope angle. The average slope angle may be measured, e.g., by taking the average of the slope angle for each pixel.

The present inventors have also found that micro-coalescence of the ink drops deposited onto the print surface may be controlled, for example, during a small window of time bounded by: i) after the ink drops have been ejected onto the print surface, and ii) before the ink vehicle has been extracted from the pigment, and absorbed into the print surface. During this window of time, the ink drops are capable of flowing together in a manner sufficient to achieve micro-coalescence, and such micro-coalesced ink drops form the desired continuous/substantially continuous ink film described above. The inventors have also found that the controlling of micro-coalescence of the ink drops during this window of time advantageously improves gloss and uniformity of the final print. In an embodiment, controlling micro-coalescence may be accomplished, for example, by achieving a relatively flat topography of the final print, rendering such print as optically smooth enough to achieve specular reflectance at most, if not all of the points on the surface of the print. In an example, specular reflectance may be achieved at more than about 99% of the surface of the print. This is also indicative of a surface that exhibits a gloss-to-haze ratio of greater than 5.0 (when measured at 2° off specular). It is to be understood that optimum gloss is achieved at specular reflectance, and when measured at 2° off specular, the gloss-to-haze ratio should be 5.0 or more. In one non-limiting example, the gloss-to-haze ratio is desirably 5.5 or more when measured at 2° off specular. In some cases, the final print exhibiting a ratio at or above 5.0 may be considered, by a viewer of such print, to be of photo quality.

Figure 1:
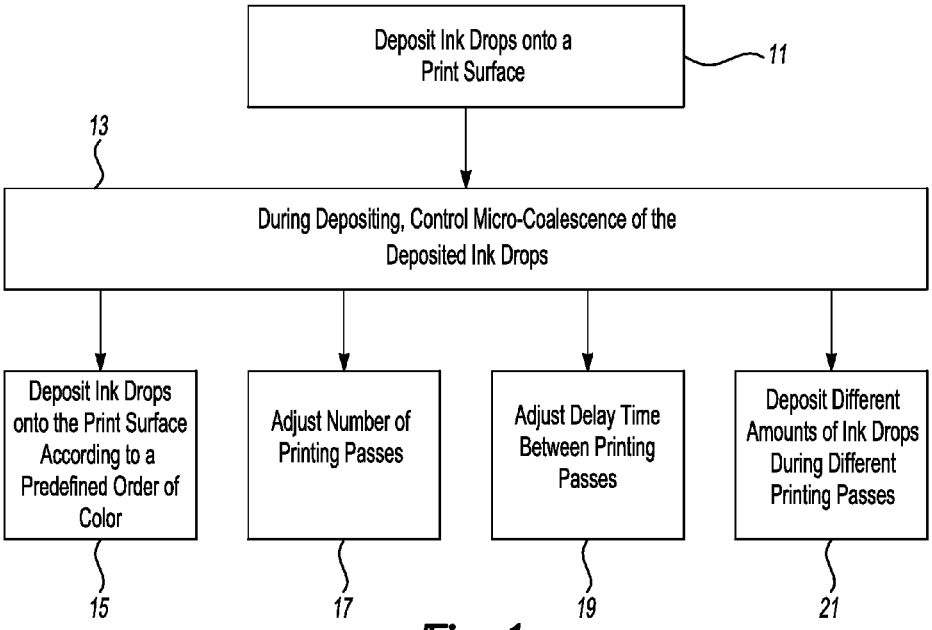
FIG. 1 is a flow diagram depicting an embodiment of a method of improving gloss of a print.
Figure 2:
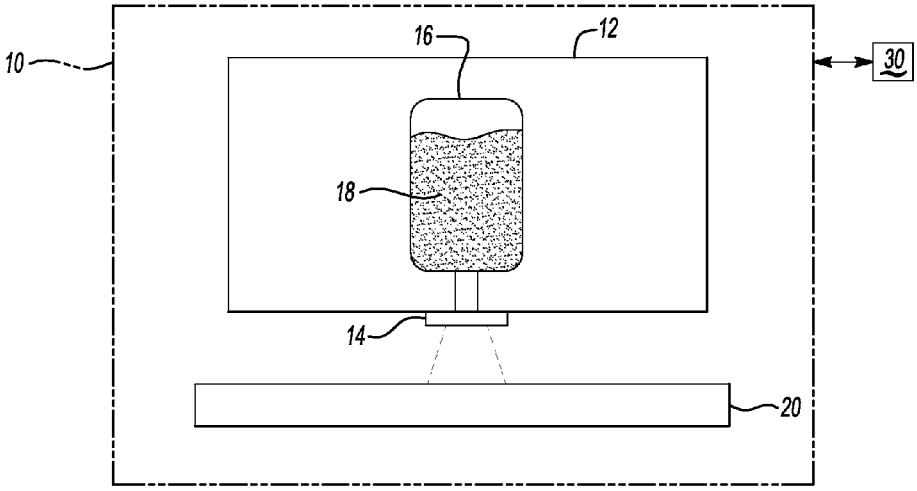
FIG. 2 semi-schematically depicts an embodiment of an inkjet printing system for use in performing the embodiment of the method depicted in FIG. 1.

Embodiment(s) of the method of improving gloss is/are generally depicted in FIG. 1, and an example of an inkjet printing system for performing the embodiment(s) is schematically depicted in FIG. 2. It is to be understood that the embodiment(s) of the method performed by the inkjet printing system 10 depicted in FIG. 2 is/are generally accomplished by configuring the system 10 to perform such embodiment(s). The configuring of the printing system 10 will be described in further detail below.

As shown in FIG. 2, the inkjet printing system 10 includes an inkjet printing device 12 (such as, e.g., a continuous device, a drop-on-demand device, a thermal inkjet (TIJ) device, or a piezoelectric inkjet device) having an inkjet fluid ejector 14 fluidically coupled to a reservoir 16. In a non-limiting example, the reservoir 14 contains an inkjet ink (identified by reference numeral 18). Such inkjet inks 18 include any inkjet ink composition including pigment colorant particles. The fluid ejector 14 may be configured to eject the ink 18 directly onto a print surface 20 (as shown in FIG. 2).

In the example depicted in FIG. 2, the printing device 12 includes a single fluid ejector 14. It is to be understood that the printing device 12 may otherwise include more than one fluid ejector 14, where each is fluidically coupled to a respective reservoir 16 (not shown in FIG. 2). For example, the inkjet printing system 10 may include an ink set having two or more inkjet inks, a fixer, and/or other composition(s), each of which may be stored in the respective reservoirs. The reservoirs may be in fluid communication with a single fluid ejector (such as the ejector 14), may be in fluid communication with two or more other fluid ejectors, or may be in fluid communication with their own respective fluid ejector.

The inkjet printing system 10 further has selectively and operatively associated therewith a processor 30 configured with a computer readable medium embodying computer readable code, and such processor 30 is capable of executing the computer readable code for performing one or more steps of embodiments of the method disclosed herein. In an example, the processor 30 is a central processing unit (CPU), and such processor 30 performs the function of a general-purpose processor.

Referring now to FIG. 1, an embodiment of the method for improving gloss includes depositing ink drops onto the print surface 20 (as shown by reference numeral 11). The ink for such ink drops may be retrieved by the fluid ejector 14 from one or more differently colored inks, each of which may be part of an ink set. In an example, such ink set may include two or more inks, each of which has a different color, or a different shade of the same color. In an example, the ink set includes six inks, e.g., a black ink, a yellow ink, a cyan ink, a light cyan ink, a magenta ink, and a light magenta ink, each of which is housed in its own reservoir 16. In some instances, the ink set further includes a fixer fluid (which, in many cases, is colorless), and such fixer fluid may also be housed in its own reservoir 16.

During inkjet printing, the ink(s) is/are deposited onto the print surface 20 in the form of ink drops by the fluid ejector 14. At substantially the same time, micro-coalescence of the deposited ink drops is also controlled (as shown by reference numeral 13).

Controlling micro-coalescence may be accomplished via several methods, where these methods are described below in detail. It is to be understood that any of the methods may be applied alone for controlling micro-coalescence, or a combination of two or more of the methods may otherwise be applied.

One of these methods includes depositing the ink drops onto the print surface 20 according to a predefined order of color (see reference numeral 15 in FIG. 1). In this method, two or more colored inks are deposited, as ink drops, onto the print surface 20 in a specific, predefined color order. For instance, if an image produced on the print surface 20 is formed from a yellow ink and a light cyan ink, such colors may be deposited onto the print surface 20 in an order that was predetermined to ultimately achieve the desired increased gloss and uniformity (as shown in the FIGS. 5 and 6 series below). In an example, the predetermined order of color is based, at least in part, on the solids loaded in the respective inks (i.e., the solids content of the ink). For instance, the inks having a lower loading of solids (i.e., pigment) should be printed before those inks having a higher loading of solids. As such, when multiple inks are used having low solids loadings (as defined hereinbelow) and/or high solids loadings, (also defined hereinbelow), it has been found that printing the ink(s) with the lower solids loading first is desirable. As such, the inks with higher weight percent solids are printed on and/or after those inks with lower weight percent solids. For example, if each of the inks is considered to be a low solids content ink (e.g., one has 10 wt % pigment loading and another has 5 wt % pigment loading), to achieve desirable gloss, the ink containing 10 wt % solids would be printed after the ink containing 5 wt % solids.

As used herein, ink compositions having a low loading of solids include those that have an amount of pigment up to, but not including 15 wt % (of the total weight percent of the ink composition). In one embodiment, the low loading of solids ranges from about 1 wt % to about 6 wt %. In another embodiment, the low loading of solids ranges from about 2 wt % to about 3.5 wt %. Ink compositions having a high loading of solids include those that have an amount of pigment that ranges from 15 wt % to about 25 wt %. It is to be understood that these low and high solids ranges are representative of solids ranges within any ink compositions.

One example of a general ink formulation includes, for example, from 5 wt % to 15 wt % cosolvents (e.g., polyols); from 1 wt % to 25 wt % colorants; from 0.1 wt % to 2 wt % surfactants; about 0.5 wt % of additives (e.g., a biocide); and a balance of water. Such a formulation has a solids content ranging from 1 wt % to 25 wt % based upon the amount of colorant utilized. It is to be understood that any color ink may be formulated as a low solids-containing ink or as a high-solids containing ink. However, lighter colored inks often, but not always, have a lower solids content than darker colored inks (e.g., light magenta as compared to magenta). In one of the examples disclosed herein, two inks (a yellow ink and a light cyan ink) were formulated according to the above formulation. In each of these compositions, the amount of pigments is less than 15 wt %. As such, both of these inks are considered to be low solids content inks. However, the amount of pigment present in the yellow ink was greater than the amount of pigment present in the light cyan ink. The pigments used in the respective inks were different in order to achieve the desired color. As will be described further in conjunction with the FIG. 5 series below, when the ink having the higher solids content (i.e., the yellow ink) is deposited onto the ink having the lower solids content (i.e., the light cyan ink), improvement in gloss and gloss uniformity results.

Figure 5A:
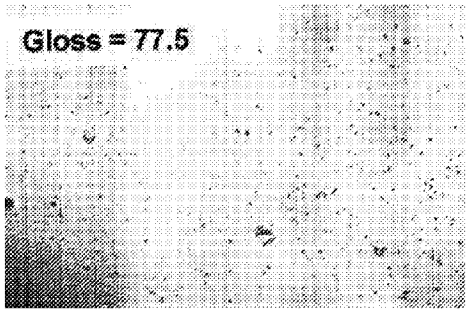
FIGS. 5A and 5B are black and white representations of photographs of a print formed by depositing a light cyan ink onto a print surface and then depositing a yellow ink over the light cyan ink.
Figure 5B:
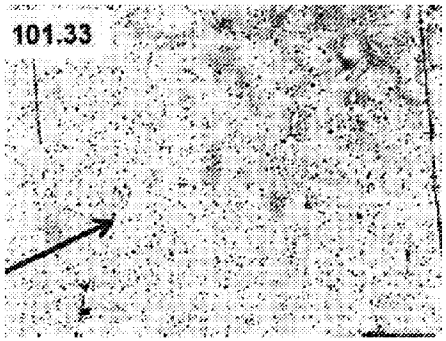
Figure 5C:
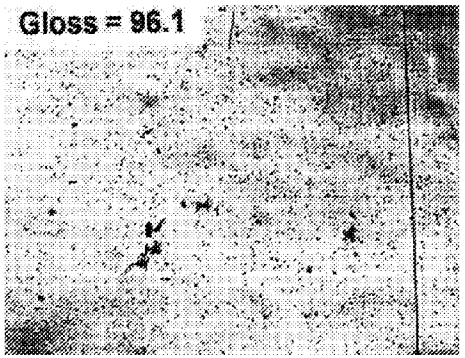
FIGS. 5C and 5D are black and white representations of photographs of a print formed by depositing the yellow ink onto a print surface and then depositing the light cyan ink over the yellow ink.
Figure 5D:
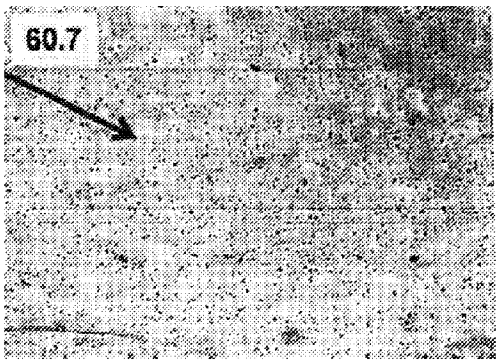

In one example, an ink set having six inks includes a light cyan ink, a black ink, a cyan ink, a light magenta ink, a magenta ink, and a yellow ink. In this particular example, the light cyan ink and black ink each have lower solids contents than each of the cyan ink, the light magenta ink, the magenta ink, and the yellow ink. The present inventors have unexpectedly and fortuitously discovered that, for this ink set, if the light cyan ink or the black ink is/are deposited before any one of the cyan ink, the light magenta ink, the magenta ink, or the yellow ink onto the print surface, the desired gloss-to-haze ratio identified above will be achieved. This is shown in the FIG. 5 series, which provides black and white schematic representations of photographs of a print where the yellow ink was printed over the light cyan ink (FIGS. 5A and 5B), and black and white schematic representations of photographs of a print where the light cyan ink was printed over the yellow ink (FIGS. 5C and 5D). From these Figures, it was determined that the print was optically smoother when the higher solids content ink (i.e., the yellow ink in this example) is printed over the lower solids content ink (i., the light cyan ink in this example) (shown in FIG. 5B). More specifically, the print including the light cyan ink deposited thereon alone had a gloss of 77.5 (shown in FIG. 5A), and after the yellow ink was printed over the light cyan ink, the print exhibited a gloss of 101.33 (shown in FIG. 5B). In contrast, the print exhibited a decrease in gloss when the light cyan ink (i.e., lower solids content ink) was deposited over the yellow ink (i.e., higher solids content ink). More specifically, the print including the yellow ink deposited thereon alone had a gloss of 96.1 (shown in FIG. 5C), and after the light cyan ink was printed over the yellow ink, the print exhibited a gloss of 60.7 (shown in FIG. 5D).

Figure 6A:
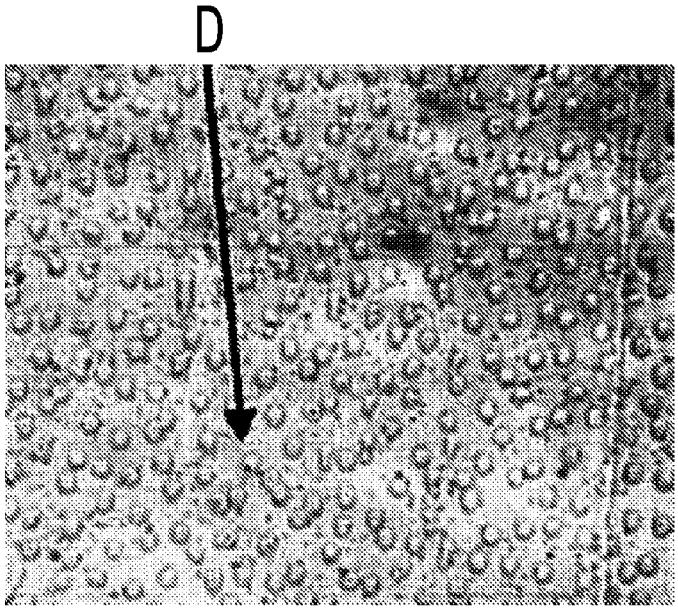
FIGS. 6A and 6B are black and white representations of photographs of another print formed by depositing the yellow ink onto a print surface and then depositing the light cyan ink over the yellow ink.
Figure 6B:
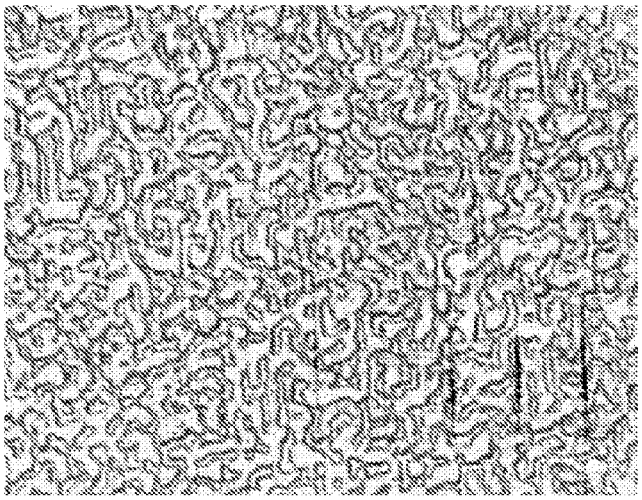

Furthermore, when the higher solids content yellow ink is printed before the lower solids content light cyan ink, the light cyan pigment retains its shape on the print surface (as shown by the ink dots D in FIG. 6A). The dots D create an uneven surface topography, which deleteriously affects gloss (as described above in conjunction at least with FIG. 4, and as shown in FIG. 6B).

However, when the higher solids content yellow ink is deposited on the lower solids content light cyan ink, the yellow ink flows over and around the ink dots, thereby creating a micro-coalesced, semi-continuous ink film generating a reduced slope angle and improved gloss.

Figure 7A:
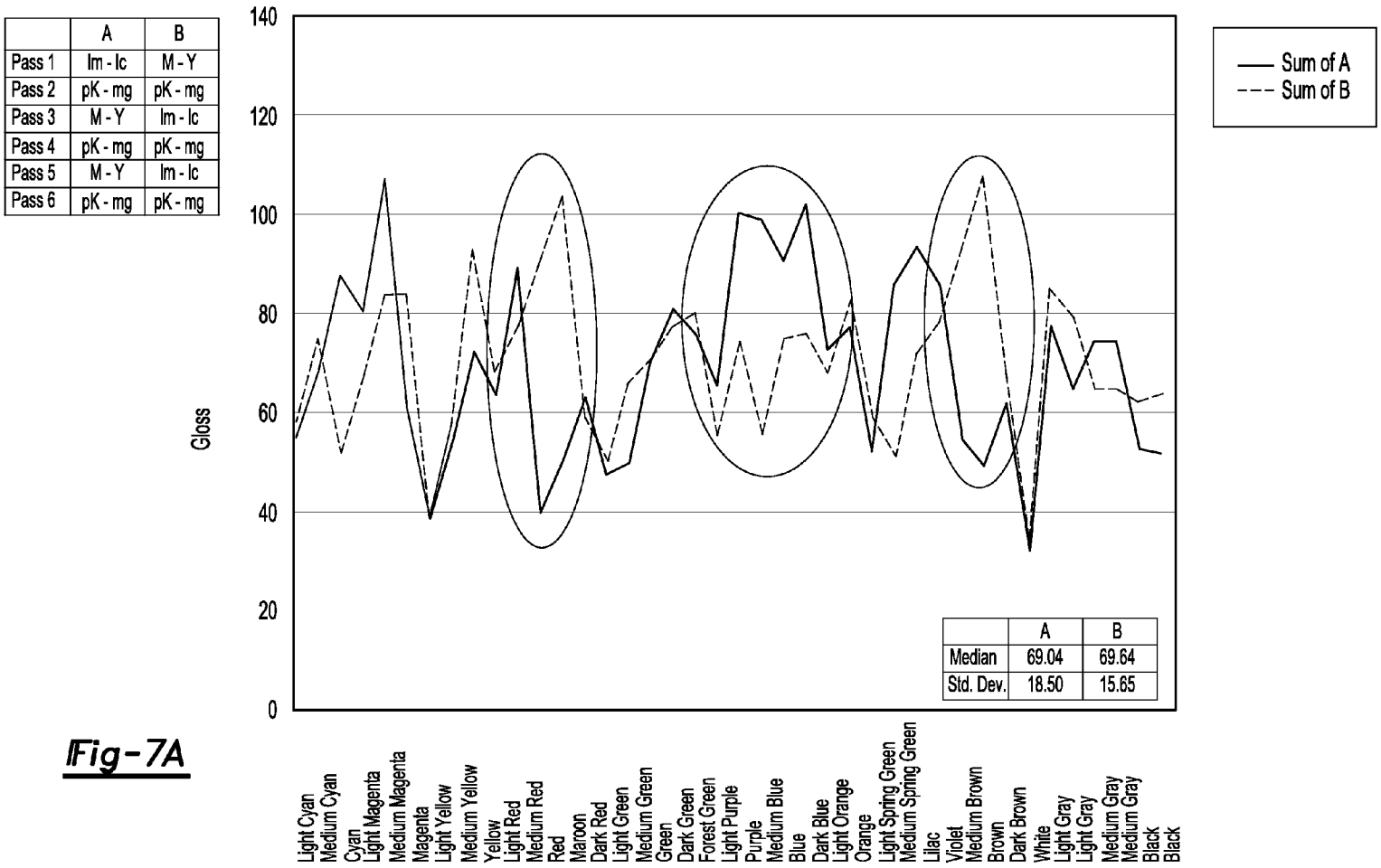
FIGS. 7A and 7B are graphs showing the gloss of a print, for each color exhibited by the image produced, when depositing inks according to a predefined order of color.
Figure 7B:
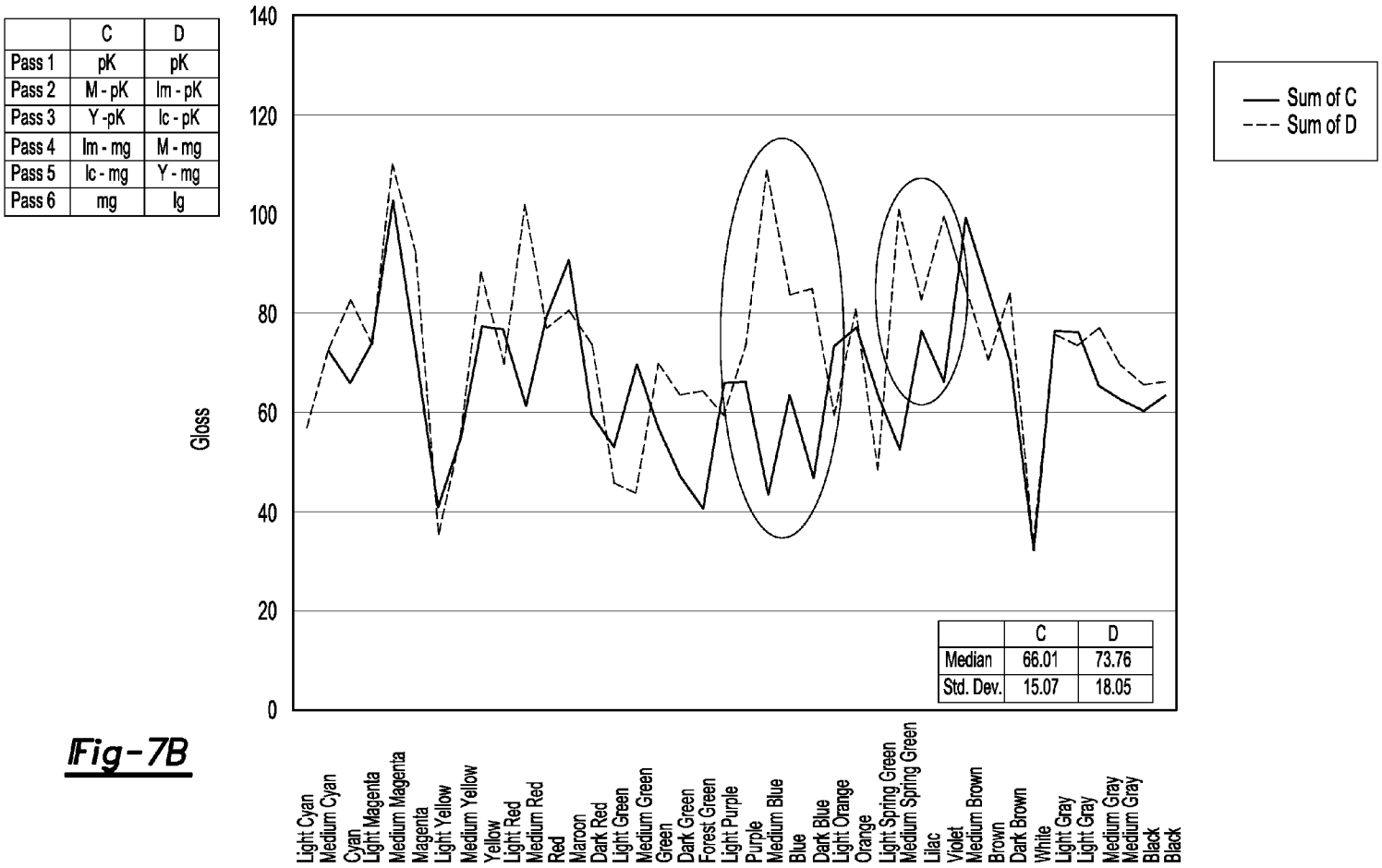

In another example, the ink set includes a light cyan ink (lc), a black ink (pK), medium grey (mg), a light magenta ink (lm), a magenta ink (M), and a yellow ink (Y). In this particular example, the magenta ink has higher solids contents than each of the light cyan ink, the medium grey ink, the light magenta ink, the black ink, and the yellow ink. The present inventors have also unexpectedly and fortuitously discovered that, for this ink set, if the magenta ink is deposited after one or more of the medium grey ink, the light cyan ink, the light magenta ink, the yellow ink, or the black ink onto a print surface, the desired gloss will be achieved. This is shown in FIGS. 7A and 7B, which are graphs illustrating i) the gloss of a print where deposition of the inks was accomplished according to a predefined order of color (y-axis), and ii) the color exhibited by the image produced (x-axis). While the gloss level does vary depending upon the wavelength of the colors on the x-axis, the results as a whole illustrate that the average gloss level is enhanced when the higher solids content magenta is printed later in the printing scheme. In FIG. 7A, the order of color deposited in printing scheme A (which included printing the higher solids content magenta ink in passes 3 and 5 of the printing sequence, and shown by the solid line in the figure) exhibited much lower gloss in the red color zones (the far right and left circles in the figure) compared with the order of color deposited according to printing scheme B (which included printing the higher solids content magenta ink first, and then the rest of the inks (having lower solids contents than the magenta ink) over the magenta ink, and is shown by the dotted line in the figure). As illustrated, however, printing scheme A exhibits much higher gloss in the blue zone (i.e., the center circle). It is to be understood that printing scheme B was performed to determine if reversing the M-Y and lm-lc passes would enhance the gloss levels in the red zones. As shown in FIG. 7A, reversing the order of these two passes did alter the gloss levels in the red zones, while also significantly lowering the gloss level in the blue zone. In the graph shown in FIG. 7B, the order of color deposited in printing scheme C (which included printing the higher solids content magenta ink earlier in the printing sequence (i.e., pass 2 of 6), and shown by the solid line in the figure) exhibited much lower gloss in the blue and purple color zones (circled in the figure) compared with the order of color deposited according to printing scheme D (which included printing the higher solids content magenta ink later (i.e., pass 4 of 6) in the printing sequence, shown by the dotted line in the figure). Printing schemes C and D are similar, except that M-Y and lm-lc have been reversed. This reversal illustrates that gloss levels are enhanced in the blue/purple zones, while not deleteriously affecting the gloss in the red zones. It is noted that the green zones (i.e., the right circle in FIG. 7B) also have enhanced gloss when printing scheme D is utilized. As such, for overall enhancement in gloss (not in one specific wavelength zone), printing the higher solids content magenta later in the printing pass is desirable.

Figure 8:
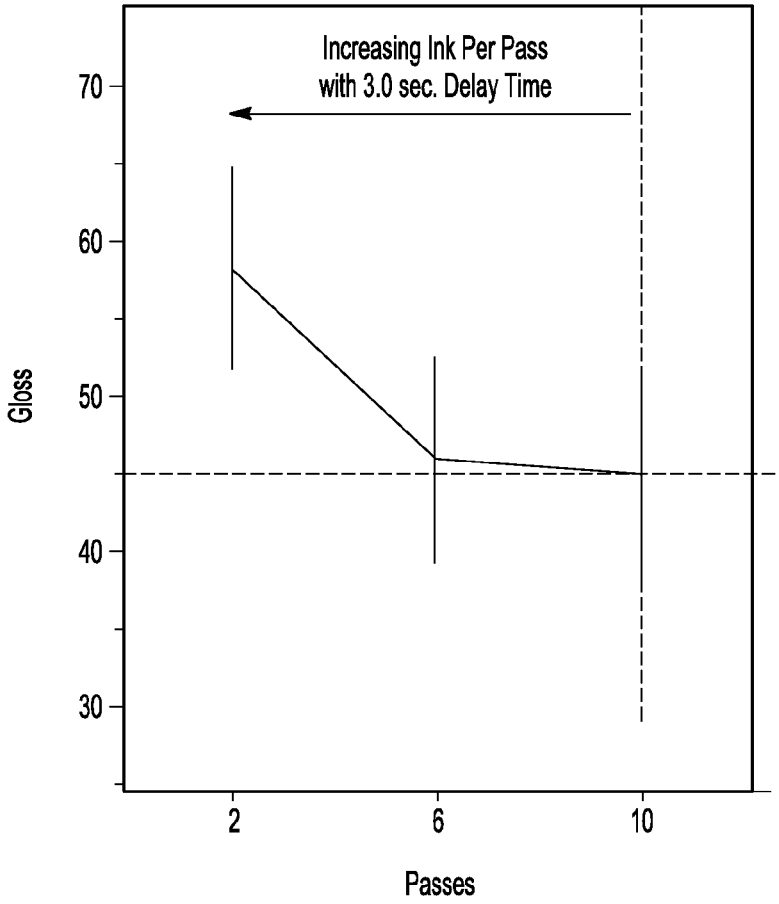
FIG. 8 is a graph showing the effect of gloss with respect to the number of printing passes.

Another method of controlling micro-coalescence of ink drops includes adjusting a number of printing passes during inkjet printing (see reference numeral 17 in FIG. 1). The adjusting of the number of printing passes includes reducing the number of printing passes from a default number of passes. In an example, the number of printing passes may be reduced by depositing at least two different inks of the ink set during a single printing pass. This would eliminate at least one printing pass that would otherwise be present if such inks were deposited separately. It is to be understood that, upon reducing the number of printing passes, more ink is deposited during a single printing pass. Since more ink is available at the same time (i.e., during the single printing pass), the ink flux increases, and promotes micro-coalescence. For example, as shown in FIG. 8, the gloss of a print generally increases as the number of printing passes decreases. This graph further shows that such improvement in gloss is minimal upon reducing the number of printing passes from ten to six, whereas more significant improvement in gloss may be achieved by reducing the number of printing passes from six. In this later case, two printing passes achieved the best gloss.

In an example, the number of printing passes may be reduced from a default number of passes (e.g., 16 passes, 10 passes, 6 passes, etc.) down to a single pass. However, to prevent potential macro-coalescence from occurring (as well as other possible undesirable printing affects (e.g., nozzle clogging) or affects caused from the macro-coalescence on the print surface), the number of printing passes may be reduced to three, four, or five passes. In an embodiment, the number of printing passes is reduced from six passes to three, four, or five passes by i) depositing the yellow ink alone onto the print surface during a printing pass, ii) depositing the magenta ink alone onto the print surface during another printing pass, and iii) depositing one or more of the light cyan ink, the cyan ink, the light magenta ink, or the black ink onto the print surface during the one, two, or three additional passes.

Yet another method of controlling micro-coalescence of ink drops includes adjusting a delay time between the printing passes (see reference numeral 19 in FIG. 1). Upon reducing the delay time between the printing passes, more ink may be deposited onto the print surface before previously-deposited ink drops are immobilized due, at least in part, to drying. It is generally understood that then-currently deposited ink drops generally cannot coalesce with dried ink drops, and thus micro-coalescence cannot be achieved. By reducing the delay time, the then-currently deposited ink drops are capable of coalescing with the previously-deposited ink drops before such ink drops have dried. This, in effect, increases the ink flux of the system. In the embodiments disclosed herein, the delay time (e.g., from 0.5 seconds to less than 3 seconds) is as short as possible before macro coalescence is observed. It is to be understood that delay time of choice is dependent upon the ink and/or media properties, the ambient temperature, humidity, and/or combinations thereof. In a non-limiting example, the delay time is adjusted to less than or equal to 2 seconds between each printing pass, which is a reduction from a typical delay time of, e.g., 3 seconds.

Still another method of controlling the micro-coalescence of ink drops includes depositing different amounts of ink drops onto the print surface during different printing passes (see reference numeral 21 in FIG. 1). This may be considered to be a variable ink flux mode, which ultimately improves gloss and uniformity. In one aspect of this method, the ink flux is adjusted while maintaining a predefined color mix. As used herein, the predefined color mix refers to the amount of each color used to achieve a printed color having a specific color space value. For instance, the printed color red (which has a specific color space value of RGB 255,0,0 (which is indicative of a color being 100% red, 0% green, and 0% blue)) may be a color mix of about 50% of the color yellow and about 50% of the color magenta. In an example, a higher amount of ink may be deposited onto the print surface during the first printing passes (e.g., during printing passes one and two of a six pass printing system), and the rest of the ink is deposited during the remaining printing passes (e.g., during printing passes, three, four, five, and six). In a more specific example, a higher amount of ink (e.g., 51% or more) is deposited onto the print surface during the first two printing passes of a six pass printing system, and a lower amount (e.g., 49% or less) of the ink is deposited during the remaining four printing passes.

For instance, a standard six pass printing system may deposit inks from an ink set containing four inks (e.g., a cyan ink, a magenta ink, a yellow ink, and a black ink). In such a six pass printing system, the same amount of ink (in terms of weight percent) of each color is deposited during each pass, as shown in Table 1 below:

TABLE 1

| A Standard Six Pass Printing System | | | | |
|---|---|---|---|---|
| | Cyan Ink | Magenta Ink | Yellow Ink | Black Ink |
| 1 | 16 | 16 | 16 | 16 |
| 2 | 16 | 16 | 16 | 16 |
| 3 | 16 | 16 | 16 | 16 |

TABLE 1-continued

| A Standard Six Pass Printing System | | | | |
|---|---|---|---|---|
| | Cyan Ink | Magenta Ink | Yellow Ink | Black Ink |
| 4 | 16 | 16 | 16 | 16 |
| 5 | 16 | 16 | 16 | 16 |
| 6 | 16 | 16 | 16 | 16 |

*The numeric values provided above represent a ratio of the percentage of the total ink flux to the weight percentage of the colorant in the ink per pixel.

In contrast, a six pass printing system configured by adjusting the ink flux, but maintaining the color mix, deposits inks from an ink set also including four inks. In this example, a higher amount of ink is deposited during the first two passes, and a lower amount of ink is depositing during the last four passes. A non-limiting example of such a six pass printing system is provided in Table 2 below:

TABLE 2

| Six Pass Printing System Where Ink Flux is Adjusted | | | | |
|---|---|---|---|---|
| | Cyan Ink | Magenta Ink | Yellow Ink | Black Ink |
| 1 | 30 | 30 | 30 | 30 |
| 2 | 20 | 20 | 20 | 20 |
| 3 | 10 | 10 | 10 | 10 |
| 4 | 10 | 10 | 10 | 10 |
| 5 | 10 | 10 | 10 | 10 |
| 6 | 10 | 10 | 10 | 10 |

*The numeric values provided above represent a ratio of the percentage of the total ink flux to the weight percentage of the colorant in the ink per pixel.

In another aspect of the instant method of controlling the micro-coalescence, both the predefined color mix and the ink flux are adjusted. For example, all of the ink for a single color (e.g., the yellow ink) may be deposited during the first two passes, while another color (e.g., the light cyan ink) may be deposited during the last pass. This is shown in Table 3 below:

TABLE 3

| Six Pass Printing System Where Ink Flux and Color Mix are Both Adjusted | | | | |
|---|---|---|---|---|
| | Cyan Ink | Magenta Ink | Yellow Ink | Black Ink |
| 1 | 0 | 50 | 0 | 16 |
| 2 | 0 | 50 | 0 | 16 |
| 3 | 0 | 0 | 0 | 16 |
| 4 | 0 | 0 | 50 | 16 |
| 5 | 0 | 0 | 50 | 16 |
| 6 | 100 | 0 | 0 | 16 |

*The numeric values provided above represent a ratio of the percentage of the total ink flux to the weight percentage of the colorant in the ink per pixel.

Some specific examples of printing schemes that may be used to achieve the desired gloss are provided in Tables 4-7 below. Each of these printing schemes is used for an ink set including a light cyan ink, a light magenta ink, a magenta ink, a yellow ink, a black ink, and a medium grey ink.

TABLE 4

| Printing Scheme for Example 1 | |
|---|---|
| Pass 1 | Light cyan and black |
| Pass 2 | Light cyan and black |
| Pass 3 | Magenta and black |
| Pass 4 | Light magenta, yellow, and magenta |
| Pass 5 | Light magenta, yellow, and magenta |
| Pass 6 | Light magenta, yellow, and magenta |

TABLE 5

| Printing Scheme for Example 2 | |
|---|---|
| Pass 1 | Medium grey and light cyan |
| Pass 2 | Medium grey and light cyan |
| Pass 3 | Medium grey and light magenta |
| Pass 4 | Black and light magenta |
| Pass 5 | Black and magenta |
| Pass 6 | Black and yellow |

TABLE 6

| Printing Scheme for Example 3 | |
|---|---|
| Pass 1 | Light magenta |
| Pass 2 | Black and light cyan |
| Pass 3 | Black and light magenta |
| Pass 4 | Magenta |
| Pass 5 | Medium grey and light cyan |
| Pass 6 | Medium grey and yellow |

TABLE 7

| Printing Scheme for Example 4 | |
|---|---|
| Pass 1 | Black and light cyan |
| Pass 2 | Medium grey and yellow |
| Pass 3 | Black and yellow |
| Pass 4 | Medium grey and light cyan |
| Pass 5 | Black and light magenta |
| Pass 6 | Medium grey and magenta |

Figure 9:
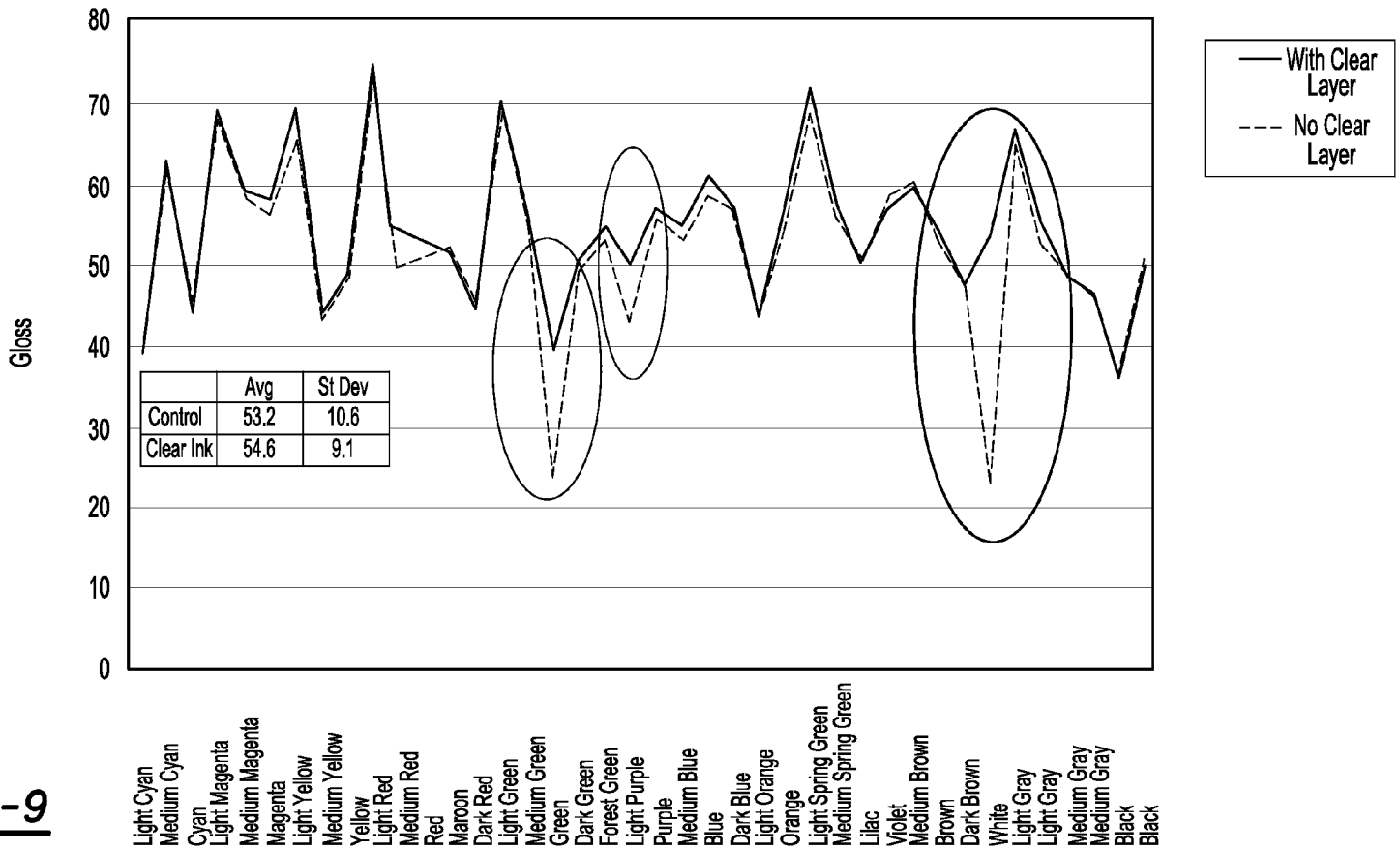
FIG. 9 is a graph showing the gloss of a print when depositing a clear ink over the print.
Figure 10A:
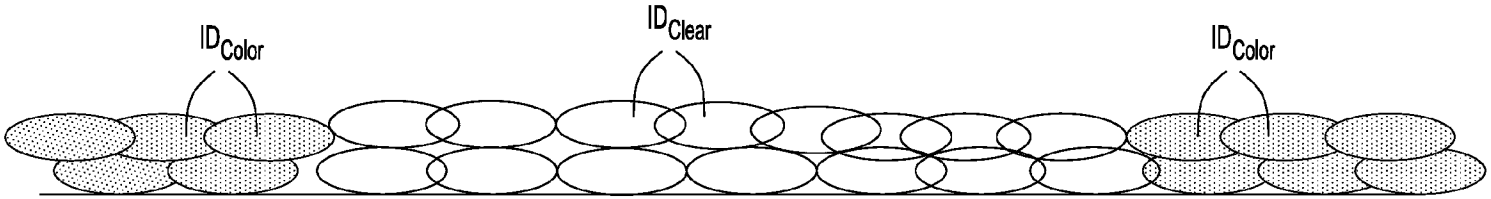
FIGS. 10A and 10B schematically depict ink drops of a clear ink deposited in white space areas of a print (shown in FIG. 10A) and in low ink density areas of a print (shown in FIG. 10B).
Figure 10B:
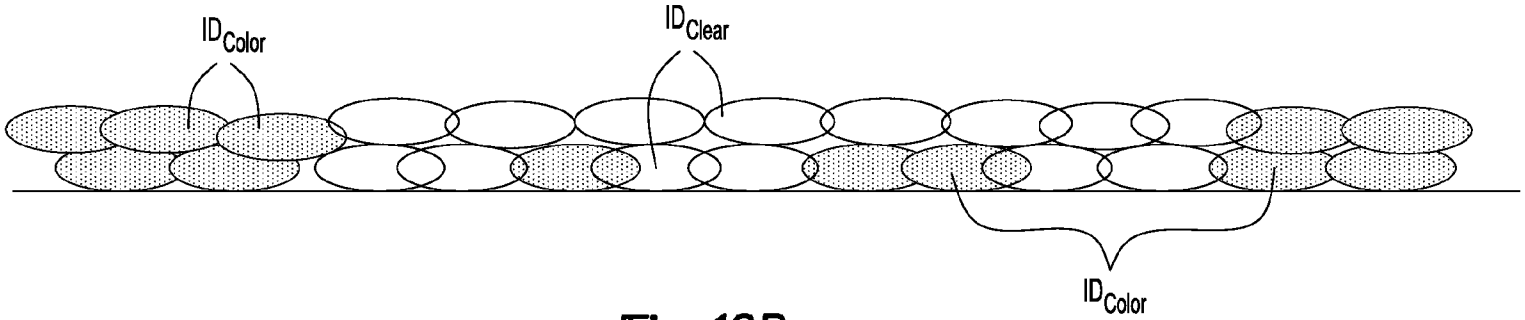

In an embodiment, the gloss uniformity of low fill areas of the print (i.e., areas on the print surface that are not covered by an ink, as referred to above as white areas) may be further improved by applying a clear ink (e.g., a fixer fluid) to the low fill areas (such as shown in FIG. 10A). The clear ink may also be applied in low density areas of the print (i.e., in areas of the print surface where there is a low density of ink applied thereon) to improve gloss uniformity of the low density areas (such as shown in FIG. 10B). In an example, the clear ink includes a medium (such as water) having polymers and/or binders dispersed therein, and no colorant. As shown in FIGS. 10A and 10B, the clear ink drops (identified by reference character $ID_{Clear}$) micro-coalesces with the colored ink drops ($ID_{color}$) to achieve the desired surface topography providing a gloss-to-haze ratio of 0.3. The improvement in gloss when the clear ink is applied to the print over i) low density inked areas, and ii) white space of the print is shown in FIG. 9. In this graph, the print including no clear ink is identified by the pink line, and shows that the gloss is significantly lower, e.g., in the green color areas and the blue color areas (which are both circled in the graph) than the print having the clear ink deposited over the inked areas (shown by the solid line). Further, the graph illustrates that the print including no clear ink (the dotted line) exhibits significantly lower gloss in the white space areas (which is also circled in the graph) than the print having the clear ink deposited over white space.

It is to be understood that the embodiment(s) of the method described above may be implemented into software and/or firmware run by the processor 30 of the printing system 10 shown in FIG. 2. As such, the method may be applied to many different printing systems by loading this software into the respective processors and/or configuring the firmware to perform one or more of the embodiment(s) disclosed herein. Furthermore, the method may also be tuned to accommodate different ink sets for different printing systems.

The implementation of the embodiment(s) of the method via the software and/or firmware into the printing system 10 may further be configured to provide options to an operator thereof. These options may include activation commands (e.g., via a one-press button or the like) to perform in a "high gloss" print mode, which would be differentiated from other print modes such as, e.g., low grain modes, maximum gamut modes, etc. The printing system 10 may also include an activation command for a "spot gloss" color, where high gloss may be achieved for a particular part of the gamut (e.g., yellows are glossier than the rest of the inks when printed).

It is to be understood that the ranges provided herein (e.g., of angles, pigment loadings, etc.) include the stated range and any value or sub-range within the stated range. For example, an amount ranging from approximately 1 wt % to about 20 wt % should be interpreted to include not only the explicitly recited amount limits of 1 wt % to about 20 wt %, but also to include individual amounts, such as 2 wt %, 3 wt %, 4 wt %, etc., and sub-ranges, such as 5 wt % to 15 wt %, 10 wt % to 20 wt %, etc.

While several embodiments have been described in detail, it will be apparent to those skilled in the art that the disclosed embodiments may be modified. Therefore, the foregoing description is to be considered exemplary rather than limiting.

What is claimed is:

1. An inkjet printing system, comprising:

a plurality of reservoirs, each configured to house one of a plurality of different colored inkjet inks of an ink set;

an inkjet fluid ejector fluidically coupled to the plurality of reservoirs, the inkjet fluid ejector being configured to deposit one or more of the different colored inkjet inks as ink drops onto a print surface during printing; and a processor selectively and operatively connected to the inkjet fluid ejector, the processor configured with a non-transitory computer readable medium embodying computer readable code for controlling micro-coalescence of the ink drops when the ink drops are deposited onto the print surface during printing, the computer readable code including:

i) computer readable code for controlling depositing of the ink drops onto the print surface according to a predefined order of color based upon solids content so that an ink with a lower solids content is printed prior to an ink with a higher solids content; and ii) computer readable code for reducing a number of printing passes to three printing passes, four printing passes, or five printing passes to increase an ink flux per printing pass, the computer readable code for reducing the number of printing passes including:

computer readable code for depositing a yellow ink alone during one of the three, four, or five printing passes;

computer readable code for depositing a magenta ink alone during an other of the three, four, or five printing passes; and computer readable code for depositing any of a light cyan ink, a cyan ink, a light magenta ink, or a black ink during one additional pass of the three printing passes, during two additional passes of the four printing passes, or during three additional passes of the five printing passes.

2. A method for improving gloss of a print, comprising:

using the inkjet printing system of claim 1 to:

deposit the one or more of the plurality of different colored inkjet inks of the ink set as ink drops onto the print surface; and control, during depositing, micro-coalescence of the deposited ink drops by at least one of:

i) depositing the ink drops onto the print surface according to the predefined order of color based upon solids content; or ii) reducing the number of printing passes by:

depositing the yellow ink alone onto the print surface during a printing pass;

depositing the magenta ink alone onto the print surface during an other printing pass; and depositing two or more of the light cyan ink, the cyan ink, the light magenta ink, and the black ink onto the print surface during one additional printing pass.

3. The method as defined in claim 2 wherein the controlling of the micro-coalescence reduces an edge formed between adjacent ink drops deposited onto the print surface during depositing, the reduced edge minimizing scattering of incident light, thereby increasing a reflective property of the print.

4. The method as defined in claim 2 wherein the plurality of inks in the ink set includes a cyan ink, a light cyan ink, a magenta ink, a light magenta ink, a yellow ink, and a black ink, each of the inks having a respective solids content, and wherein the depositing of the ink drops onto the print surface according to the predefined order of color includes depositing, onto the print surface, the light cyan ink or the black ink prior to depositing the cyan ink, the light magenta ink, the magenta ink, or the yellow ink, the respective solids content of each of the light cyan ink and the black ink is lower than the respective solids content of each of the cyan ink, the light magenta ink, the magenta ink, or the yellow ink.

5. The method as defined in claim 2 wherein the plurality of inks in the ink set includes a cyan ink, a light cyan ink, a magenta ink, a light magenta ink, a yellow ink, and a black ink, each of the inks having a respective solids content, and wherein the depositing of the ink drops onto the print surface according to the predefined order of color includes depositing, onto the print surface, the magenta ink after one or more of the cyan ink, the light cyan ink, the light magenta ink, the yellow ink, or the black ink, the solids content of the magenta ink being higher than the solids content of each of the cyan ink, the light cyan ink, the light magenta ink, the yellow ink, or the black ink.

6. The method as defined in claim 2 wherein the controlling of the micro-coalescence further includes applying a clear ink to at least one of at least one low fill area of the print surface or at least one low ink density area of the print surface.

7. The method as defined in claim 2 wherein the print exhibits a gloss-to-haze ratio of greater than 5.0.

8. The system as defined in claim 1 wherein the plurality of inks in the ink set includes a cyan ink, a light cyan ink, a magenta ink, a light magenta ink, a yellow ink, and a black ink, each of the inks having a respective solids content, and wherein the computer readable code for controlling the depositing of the ink drops onto the print surface according to the predefined order of color includes computer readable code for depositing, onto the print surface, at least one of the light cyan ink or the black ink prior to depositing the cyan ink, the magenta ink, the yellow ink, or the light magenta ink, the respective solids content of each of the light cyan ink and the black ink being lower than the respective solids content of each of the cyan ink, the magenta ink, the yellow ink, or the light magenta ink.

9. The system as defined in claim 1 wherein the plurality of inks in the ink set includes a cyan ink, a light cyan ink, a magenta ink, a light magenta ink, a yellow ink, and a black ink, each of the inks having a respective solids content, and wherein the computer readable code for controlling the depositing of the ink drops onto the print surface according to the predefined order of color includes computer readable code for depositing, onto the print surface, the magenta ink after one or more of the cyan ink, the light cyan ink, the light magenta ink, the yellow ink, or the black ink, the solids content the magenta ink being higher than the solids content of each of the cyan ink, the light cyan ink, the light magenta ink, the yellow ink, or the black ink.

10. The system as defined in claim 1, further comprising computer readable code for reducing a delay time between printing passes such that the ink drops are deposited before previously deposited ink drops have dried, and wherein the delay time between each printing pass ranges from about 0.5 seconds to about 2 seconds.

11. The system as defined in claim 1 wherein the computer readable code for controlling includes computer readable code for applying a clear ink to at least one of at least one low fill area of the print surface or at least one low ink density area of the print surface.

12. The system as defined in claim 1 wherein the computer readable code for controlling depositing of the ink drops onto the print surface according to the predefined order of color based upon solids content includes:

computer readable code for dispensing a light cyan ink and a black ink during a first printing pass and a second printing pass;

computer readable code for dispensing a magenta ink and the black ink during a third printing pass; and computer readable code for dispensing each of a light magenta ink, a yellow ink, and the magenta ink during each of a fourth printing pass, a fifth printing pass, and a sixth printing pass.

13. The system as defined in claim 1 wherein the computer readable code for controlling depositing of the ink drops onto the print surface according to the predefined order of color based upon solids content includes:

computer readable code for dispensing a medium grey ink and a light cyan ink during a first printing pass and a second printing pass;

computer readable code for dispensing the medium grey ink and a light magenta ink during a third printing pass;

computer readable code for dispensing a black ink and the light magenta ink during a fourth printing pass;

computer readable code for dispensing the black ink and a magenta ink during a fifth printing pass; and computer readable code for dispensing the black ink and a yellow ink during a sixth printing pass.

14. The system as defined in claim 1 wherein the computer readable code for controlling depositing of the ink drops onto the print surface according to the predefined order of color based upon solids content includes:

computer readable code for dispensing a black ink and a light cyan ink during a first printing pass;

computer readable code for dispensing a medium grey ink and a yellow ink during a second printing pass;

computer readable code for dispensing the black ink and the yellow ink during a third printing pass;

computer readable code for dispensing the medium grey ink and the light cyan ink during a fourth printing pass;

computer readable code for dispensing the black ink and a light magenta ink during a fifth printing pass; and computer readable code for dispensing the medium grey ink and a magenta ink during a sixth printing pass.

* * * * *

UNITED STATES PATENT AND TRADEMARK OFFICE

CERTIFICATE OF CORRECTION

PATENT NO. : 8,474,934 B1
APPLICATION NO. : 12/772152
DATED : July 2, 2013
INVENTOR(S) : Brian E. Curcio et al.

It is certified that error appears in the above-identified patent and that said Letters Patent is hereby corrected as shown below:

In the Claims:

In column 14, line 8, in Claim 9, delete “content” and insert -- content of --, therefor.

Signed and Sealed this
Third Day of September, 2013

Teresa Stanek Rea
*Acting Director of the United States Patent and Trademark Office*